US005317795A

United States Patent [19]

Bolton et al.

[11] Patent Number: 5,317,795

[45] Date of Patent: Jun. 7, 1994

[54] RETRACTABLE HANDLE FOR A ROOM AIR CONDITIONER

[75] Inventors: Theodore S. Bolton, Liverpool; John H. Michaels, Baldwinsville, both of N.Y.

[73] Assignee: Carrier Corporation, Syracuse, N.Y.

[21] Appl. No.: 14,398

[22] Filed: Feb. 5, 1993

[51] Int. Cl.[5] ..... A47B 95/02

[52] U.S. Cl. ..... 29/434; 16/115; 16/124; 16/DIG. 24; 190/115; 294/15; 294/27.1; 312/244

[58] Field of Search ..... 16/115, 124, DIG. 24, 16/125; 29/434; 190/115, 117; 294/15, 27.1, 158; 312/244, 348.6

[56] References Cited

U.S. PATENT DOCUMENTS

| | | | |
|---|---|---|---|
| 2,181,208 | 11/1939 | Satz | 190/115 |
| 2,682,972 | 7/1954 | Ringler | 16/125 |
| 3,500,738 | 12/1967 | Wenig . | |
| 4,241,472 | 12/1980 | Iannarone | 16/115 |
| 4,727,620 | 3/1988 | Gummelt | 16/115 |
| 4,825,506 | 5/1989 | Weltz | 16/124 |
| 5,075,926 | 12/1991 | Jeong | 16/115 |

FOREIGN PATENT DOCUMENTS

| | | | |
|---|---|---|---|
| 226769 | 9/1985 | United Kingdom | 190/115 |
| 440581 | 12/1967 | Switzerland | 294/158 |
| 419871 | 11/1934 | United Kingdom | 16/125 |

*Primary Examiner*—Lowell A. Larson
*Assistant Examiner*—Donald M. Gurley
*Attorney, Agent, or Firm*—Harris Beach & Wilcox

[57] ABSTRACT

A retractable carrying handle for a room air conditioning unit that is easily assembled with the main structural member of the unit to provide a high strength, safe means for installing and removing the unit from a window frame or the like for transporting the unit from place to place.

7 Claims, 4 Drawing Sheets

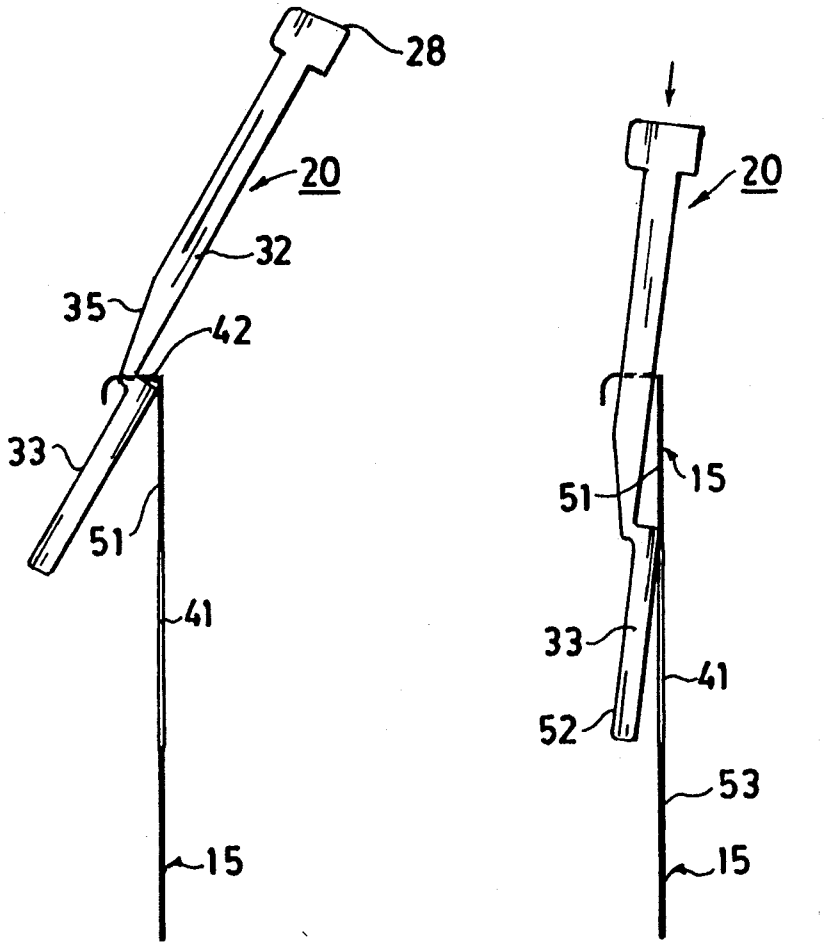
FIG. 6
FIG. 7
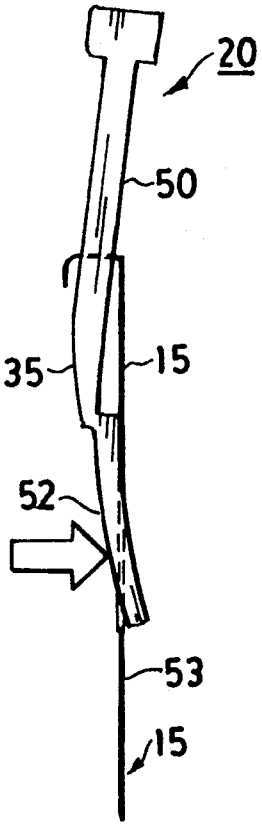
FIG. 8
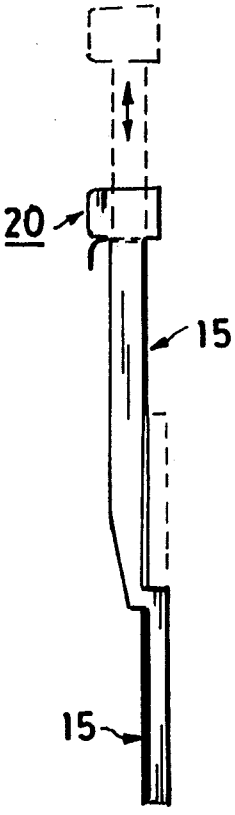
FIG. 9

RETRACTABLE HANDLE FOR A ROOM AIR CONDITIONER

BACKGROUND OF THE INVENTION

This invention relates to a portable room air conditioner and, in particular, to a retractable handle for use in a portable room air conditioner.

More specifically, this invention involves a window air conditioning unit that can be easily installed within a window frame and removed to storage when the cooling season has ended. Many window units found in the prior art are not equipped with handles or other suitable devices to facilitate lifting and carrying the unit. As a consequence, these units are difficult to install and remove from a window frame. U.S. Pat. No. 3,500,738 to Wenig illustrates a multiple use window air conditioning unit that has a handle attached to the top wall of the unit housing. As can be seen, the handle protrudes above the top wall of the housing and thus can impede, rather than aid, in the installation of the unit. The handle can be readily seen and clearly detracts from the aesthetic value of the unit. Lastly, the housings used to enclose most window units are fabricated from thin, metal or plastic sheets. Accordingly, lifting the relatively heavy unit by use of the Wenig-type handle can cause the housing to become deformed, or even to break, thus posing a potential danger to the user.

SUMMARY OF THE INVENTION

It is therefore an object of the present invention to improve window room air conditioning units.

A further object of the present invention is to provide a lifting handle for a portable room air conditioning unit that is securely attached to a rigid structural member of the unit.

A still further object of the present invention is to provide a portable room air conditioning unit with a handle that retracts into the unit when not in use.

Another object of the present invention is to provide a retractable handle for a portable room air conditioning unit that has high strength, yet is aesthetically pleasing.

While another object of the present invention is to provide a retractable handle for a window air conditioning unit that can be rapidly assembled without the need of special tools or the like.

Yet another object of the present invention is to provide a self-contained, lifting device that will facilitate safe transportation, installation and removal of window air conditioning units.

These and other objects of the present invention are attained by a handle for use in a window air conditioning unit that is slidably contained within a rigid structural member that forms part of the unit support frame. The handle is adapted to retract into the unit when not in use. When extended, the handle transfers the carrying load to the structural member so that the unit can be lifted safely when being transported, or installed and removed from a window frame. The handle can be easily assembled with the structural member during manufacture without the need of special tools, thus reducing the cost and the time required to produce a unit.

BRIEF DESCRIPTION OF THE DRAWINGS

For a better understanding of the present invention, reference shall be made to the detailed description below which shall be read in conjunction with the accompanying drawings, wherein:

FIGS. 6–9 illustrate the steps involved in assembling the handle with the main structural panel of the present unit;

DESCRIPTION OF THE INVENTION

Figure 1:
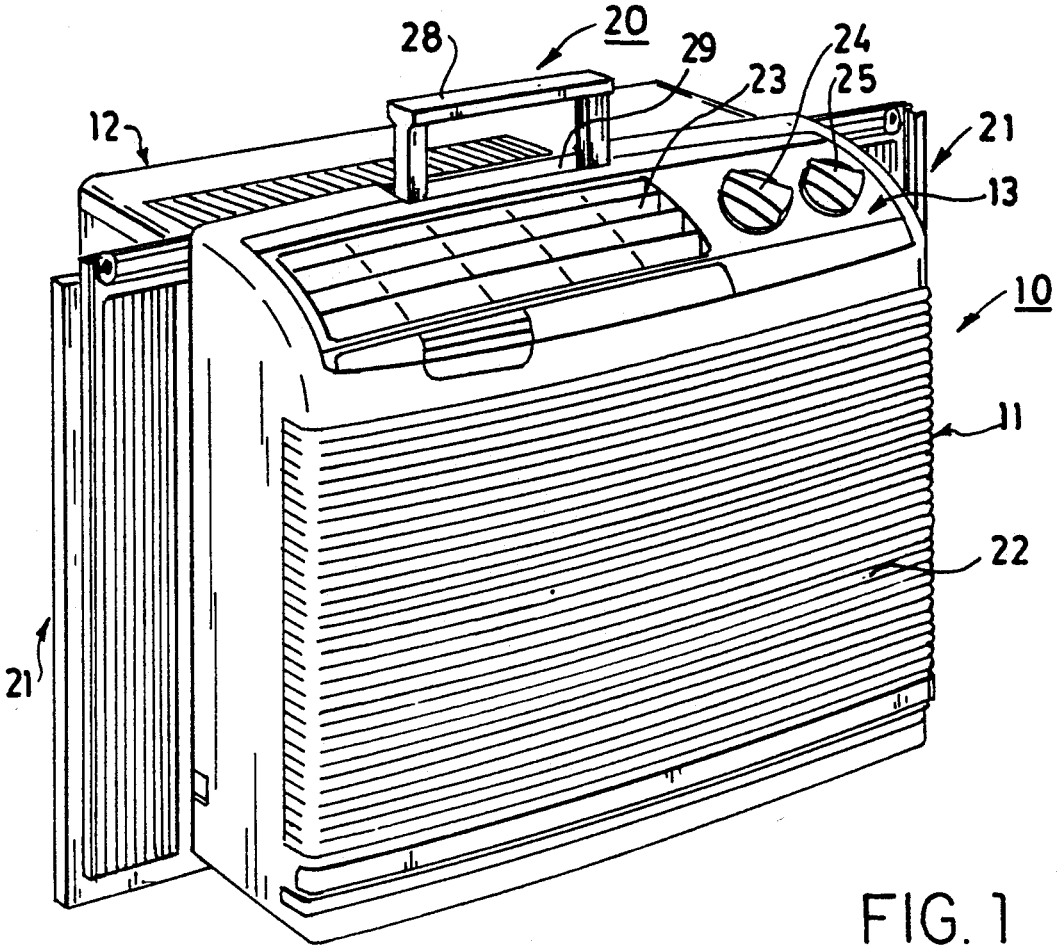
FIG. 1 is a perspective view of a window air conditioning unit equipped with a retractable handle embodying the present invention showing the handle in an extended position.
Figure 2:
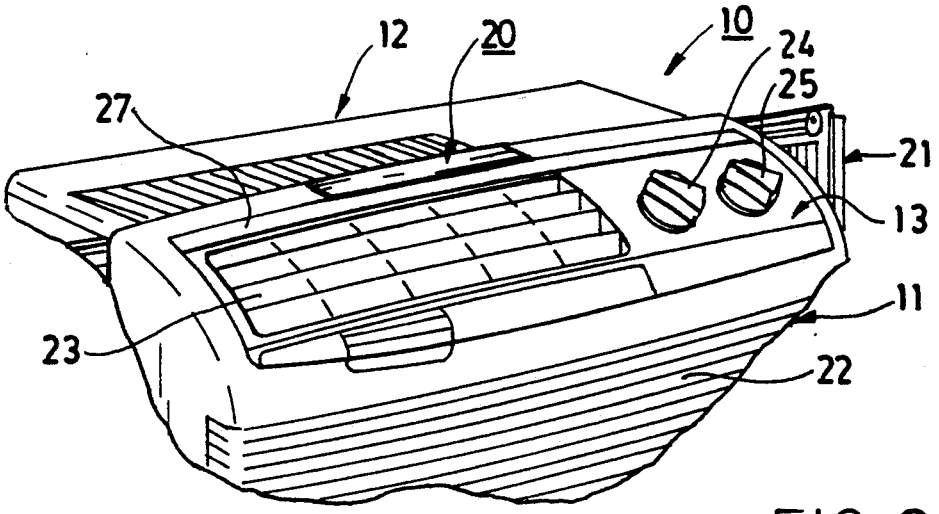
FIG. 2 is a partial view, in perspective of the unit shown in FIG. 1, illustrating the handle retracted into the top shelf of the unit.
Figure 5:
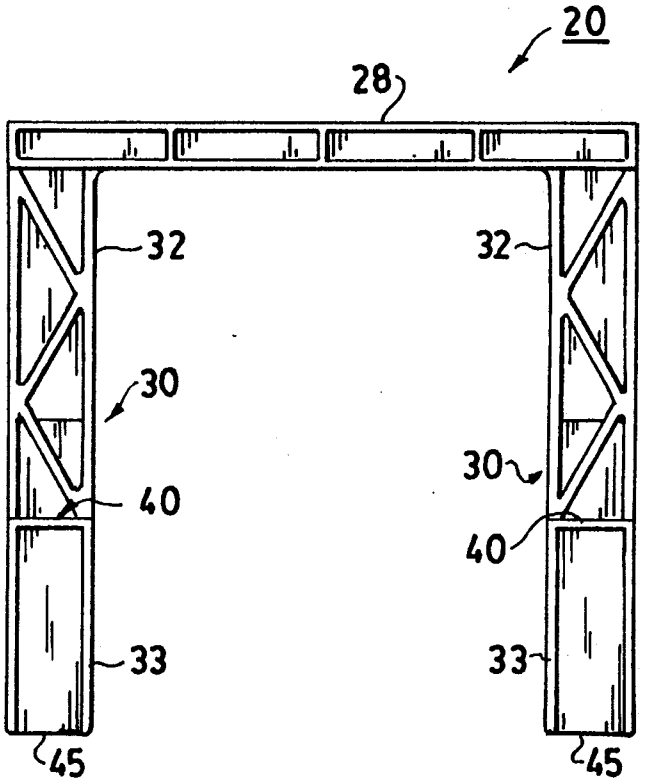
FIG. 5 is a rear elevation of the handle shown in FIG. 3.

Referring initially to the FIGS. 1 and 2, there is shown a portable window air conditioning unit generally referenced 10. The unit includes a front cover 11, a rear cover 12, and a front deck 13, all of which are fabricated of molded plastic and supported upon a vertically-disposed, high strength, main structural panel 15 (FIG. 10), centrally located inside the unit. The covers and the deck are arranged so that they can be quickly assembled upon the main structural panel without the use of special tools and the like. As will be explained in greater detail below, the unit is equipped with a retractable handle 20 that is slidably contained within the main structural panel that provides for ease of transportation, as well as safe installation and removal of the unit from a window frame.

The unit is furnished with expandable side curtains 21—21 that are adapted to move against the window frame and thus close the window opening when the unit is resting thereon. Room air is drawn into the unit through the louvered face 22 of the front cover. After being cooled, the air is discharged from the unit via an exhaust duct 23 located in the top deck of the unit. A pair of control dials 24 and 25 are also conveniently mounted in the top deck.

As illustrated in FIG. 2, the handle 20 is adapted to be retracted into the top shelf 27 of the front cover when not in use. The hand-engageable cross member 28 of the handle fits snugly into a recess 29 formed in the top shelf to provide the unit with a smooth, aesthetically pleasing appearance when the handle is in the stored or retracted position.

Figure 4:
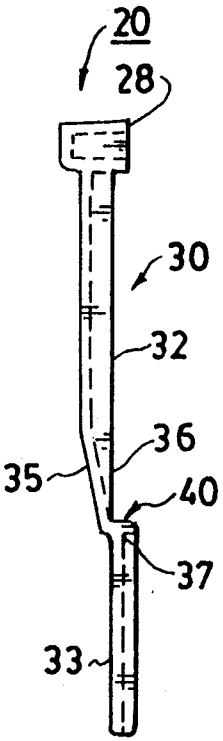
FIG. 4 is a side elevation of the handle shown in FIG. 3.
Figure 3:
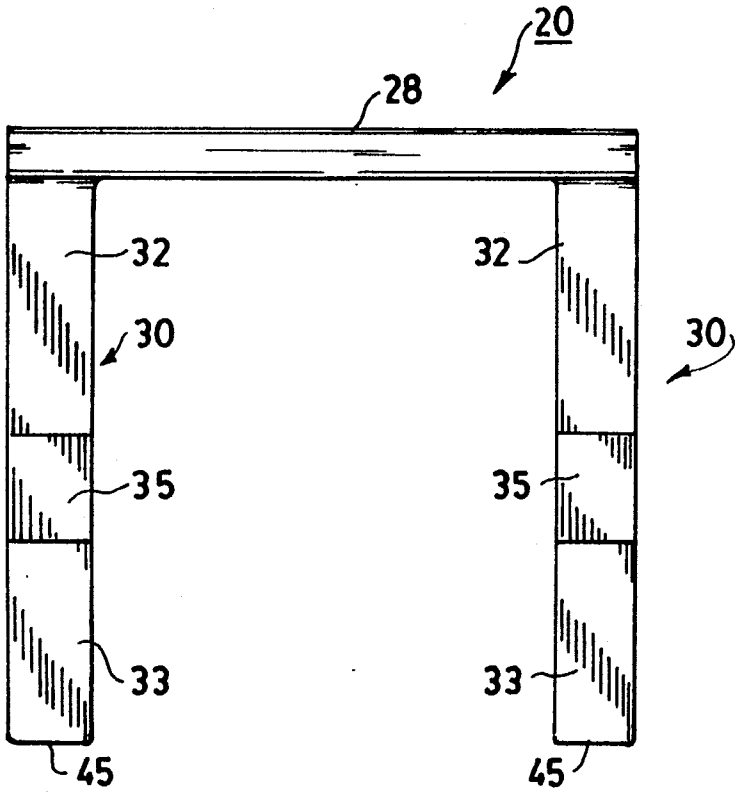
FIG. 3 is an enlarged front elevation of the handle utilized in the present unit.

Turning now to FIGS. 3 and 4, handle 20 is integrally molded of a high strength plastic and includes two spaced-apart, vertically-disposed legs 30 and 30 that are co-joined by the previously noted cross member 28. Each leg is of similar construction and includes an upper body section 32 and a lower offset section 33 that is laterally displaced to the rear of the upper body section. The two sections are joined by a bendable knee 35 that permits each leg to resiliently flex or bend about the knee. The back wall 36 of each of the upper leg sections combines with the top surfaces 37 of the lower offset section to establish a generous shoulder 40, the function of which will be explained in greater detail below.

Figure 11:
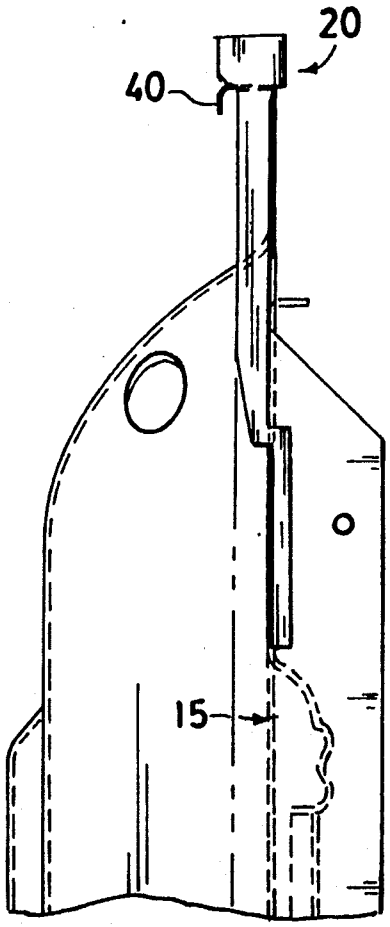
FIG. 11 is a partial side elevation of the assembly shown in FIG. 10.
Figure 10:
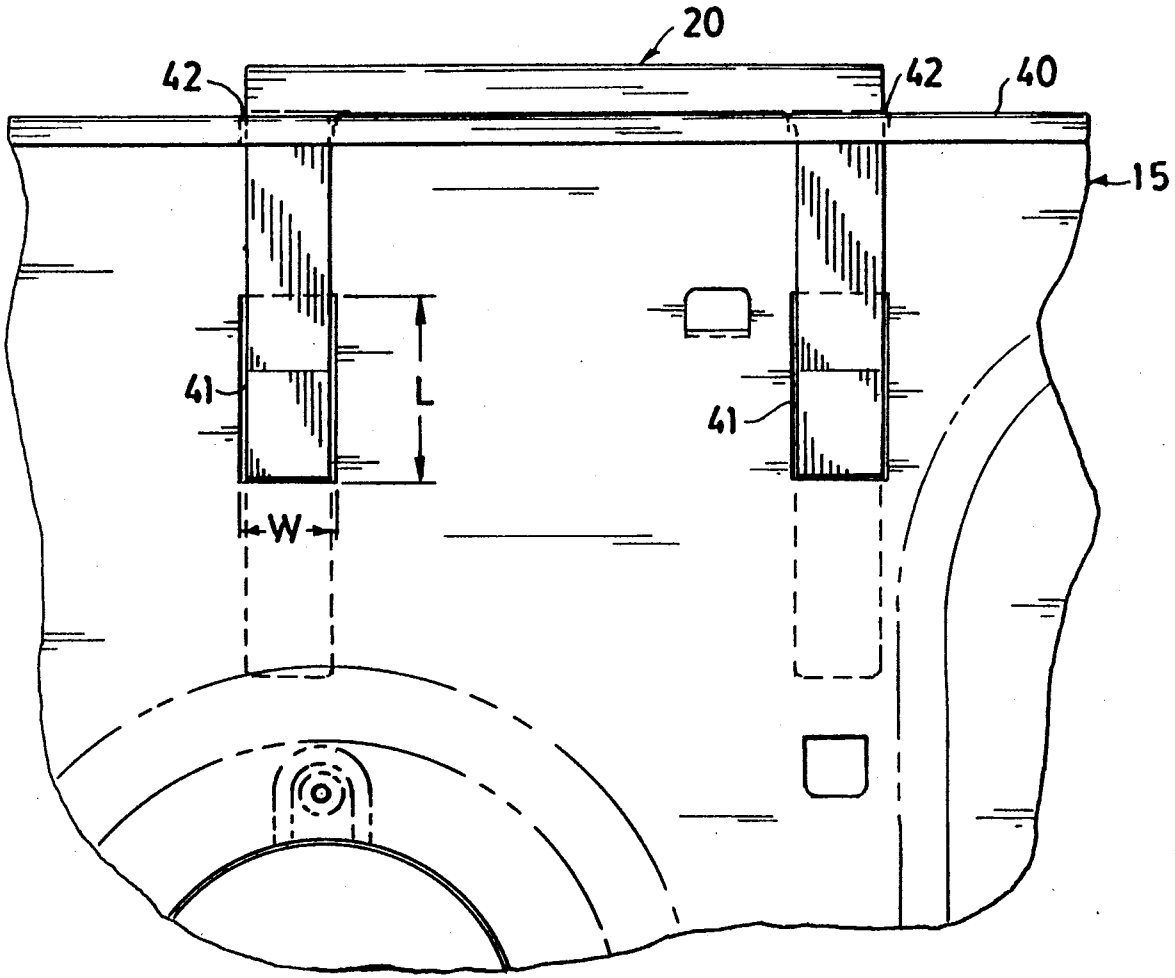
FIG. 10 is a partial front elevation showing the handle assembled with the main structural panel of the unit.

With further reference to FIGS. 10 and 11, the main structural panel 15 of the unit is a vertically-disposed, relatively rigid member that has an integral, horizontal top flange 40. The panel contains a pair of spaced-apart, rectangular-shaped, slotted holes 41—41, each of which has a given length L and a given width W. The slotted openings are spaced apart a distance equal to the spacing between the legs of the handle and are adapted to permit the offset lower section of the legs to pass laterally therethrough. The top flange of the panel also has a pair of openings 42—42 that are co-axially aligned with the slotted holes 41—41. The top openings have sufficient width to permit the legs of the handle to pass freely therethrough.

The handle is assembled with the panel by initially passing the legs of the handle downwardly through the openings in the top flange 40 as seen in FIG. 6. The legs are then lowered to bring the offset lower sections 33—33 adjacent to the two slotted holes 41—41 in the panel. The length of each lower section, as measured from the top shoulder 37 to the bottom edge of the leg, is greater than the length L of the slotted opening. With the legs so positioned, each leg is flexed rearwardly at the knee sufficiently so that the bottom edge of each leg passes through one of the slotted holes, as illustrated in FIG. 8. Once the bottom edges of the legs have passed through the slotted holes, the handle is moved downwardly, as shown in FIG. 9, whereupon the entire offset lower section of each leg is forced laterally through the adjacent slotted hole, thus locking the handle within the panel.

When locked in place, the back wall 50 of the body section of each handle leg is held in sliding contact against the front face 51 of the panel, while the front wall 52 of the offset lower leg section is held in sliding contact with the back face 53 of the panel. The shoulder 37 that is located at the top edge of the offset lower section of each handle leg will move into contact with the top wall of the adjacent slotted opening when the handle is brought to a fully extended position, as shown in FIG. 1. Because the offset lower section of the leg is of greater length than the length of the slotted opening, the leg cannot become dislodged from the panel once it has been locked in place. The panel, and thus the weight of the unit, will thus be suspended from the handle when the unit is lifted by the handle. The handle is centrally located on the unit to provide for good balance when the unit is lifted. Upon release of the handle, it can be retracted out of the way into the top shelf recess, as shown in FIG. 2. The front cover snaps onto the unit. Cutouts are provided in the recess region of the top shelf so that the cross member of the handle will pass into the recess region when the front cover is snapped into place.

While this invention has been explained with reference to the structure disclosed herein, it is not confined to the details set forth and this application is intended to cover any modifications and changes as may come within the scope of the following claims:

What is claimed is:

1. Apparatus for carrying a portable room air conditioning unit that includes a vertically-disposed panel having a front face and a back face which forms a structural part of an air conditioning unit, said panel containing a pair of parallel, vertically-disposed, slotted holes of predetermined length and width, said panel further including a horizontally-disposed top flange having a pair of openings passing therethrough, said openings being about equal in width as the slotted holes in said panel and being coaxially aligned therewith, handle means containing a pair of spaced apart, vertically-disposed legs connected at the top by a hand-engageable cross member, each of said legs having an upper body section and a lower, laterally offset section, each lower offset section being of greater length than the length of the slotted holes, each leg passing downwardly through one of said flange openings and the offset section passing laterally through one of said slotted holes so that the upper body section of the leg is adjacent to the front face of the panel and the lower offset section is adjacent to the back face of the panel, and a stop means at the top of each offset section that is arranged to move into contact with the top surface of one of the slotted openings whereby the handle can be moved between a first extended position and a second retracted position within the panel.

2. The apparatus of claim 1 wherein the handle is molded of a single piece of material.

3. The apparatus of claim 1 wherein the slotted holes formed in the panel are rectangular in form.

4. The apparatus of claim 1 wherein said panel is the main structural member of the unit.

5. The apparatus of claim 4 wherein the handle is centrally located in the mid-region of the panel.

6. The apparatus of claim 1 wherein the air conditioning unit includes a top shelf containing a recess for receiving the cross member of the handle therein when the handle is in a retracted position.

7. The method of mounting a retractable carrying handle in a portable window air conditioning unit that includes the steps of securely mounting a vertically-disposed panel having a horizontally-disposed top flange within a window air conditioner, forming a pair of spaced apart openings in the top flange, forming a pair of vertically-disposed, slotted holes in the panel that are co-aligned with said top openings in said flange, providing a handle having two spaced apart, bendable legs co-joined at the top thereof by a cross member, each leg having an upper body section and a laterally offset bottom section that has a length greater than the vertical length of the slotted holes, passing said legs downwardly through the openings in said flange and bending the legs sufficiently to pass at least a portion of the offset bottom section of each leg through one of said slotted holes, and forcing the handle downwardly to pass the offset bottom section completely through said slotted holes whereby the body section of each leg rests in sliding contact against one face of the panel and the offset bottom section rests in sliding contact against the other face of the panel.

* * * * *